US007204675B2

(12) United States Patent
Texier

(10) Patent No.: US 7,204,675 B2
(45) Date of Patent: Apr. 17, 2007

(54) COOLED GAS TURBINE ENGINE VANE

(75) Inventor: Christophe Texier, Migne-Auxances (FR)

(73) Assignee: Snecma Moteurs, Paris (FR)

( * ) Notice: Subject to any disclaimer, the term of this patent is extended or adjusted under 35 U.S.C. 154(b) by 8 days.

(21) Appl. No.: 10/916,435

(22) Filed: Aug. 12, 2004

(65) Prior Publication Data

US 2005/0089395 A1 Apr. 28, 2005

(30) Foreign Application Priority Data

Aug. 12, 2003 (FR) ..... 03 09869

(51) Int. Cl.
*F01D 5/18* (2006.01)

(52) U.S. Cl. ..... 416/96 A; 415/115; 415/191

(58) Field of Classification Search ..... 415/115, 415/191; 416/96 A
See application file for complete search history.

(56) References Cited

U.S. PATENT DOCUMENTS

| | | | | |
|---|---|---|---|---|
| 3,767,322 A | | 10/1973 | Durgin et al. | |
| 4,288,201 A | * | 9/1981 | Wilson | 415/115 |
| 4,962,640 A | * | 10/1990 | Tobery | 60/782 |
| 5,511,937 A | | 4/1996 | Papageorgiou | |
| 5,749,701 A | * | 5/1998 | Clarke et al. | 415/115 |
| 6,065,928 A | * | 5/2000 | Rieck et al. | 415/115 |
| 6,109,867 A | | 8/2000 | Jacques Portefaix | |
| 6,561,757 B2 | * | 5/2003 | Burdgick et al. | 415/115 |
| 7,008,185 B2 | * | 3/2006 | Peterman et al. | 416/96 A |
| 2003/0026689 A1 | | 2/2003 | Burdgick et al. | |

FOREIGN PATENT DOCUMENTS

| | | |
|---|---|---|
| EP | 0 381 955 | 8/1990 |
| EP | 0 974 733 | 1/2000 |
| EP | 1 149 982 | 10/2001 |
| EP | 1 154 124 | 11/2001 |
| EP | 1 191 189 | 3/2002 |
| EP | 1 251 243 | 10/2002 |

* cited by examiner

*Primary Examiner*—Edward K. Look
*Assistant Examiner*—Nathan Wiehe
(74) *Attorney, Agent, or Firm*—Oblon, Spivak, McClelland, Maier & Neustadt, P.C.

(57) ABSTRACT

A cooled gas turbine vane includes a cast part and a longitudinal sleeve obtained by shaping metal sheet The cast part includes a longitudinal body provided with a longitudinal cavity having a first opening and a second opening at the ends The sleeve is mounted in the cavity by being firmly affixed to the wall of the first opening, and one end part of which being free to slide in the second opening forming a guide. The end part includes a part having constricted dimensions relative to the transverse dimensions of the guide.

13 Claims, 2 Drawing Sheets

COOLED GAS TURBINE ENGINE VANE

The present invention relates to the cooling of vanes in a gas turbine engine, in particular the vanes of a turbine nozzle.

In a gas turbine engine, the air is compressed in a compressor and is mixed with a fuel in the combustion chamber. The flow leaving the latter feeds one or several turbines stages, before being ejected into an exhaust nozzle.

The turbine stages comprise rotors separated by nozzles, or distributors, for orienting the gas flow. Because of the temperature of the gas that passes over them, the vanes are subjected to very severe operating conditions; it is therefore necessary to cool them, generally by forced convection or even by air impact on the inside of the vanes.

FIG. 1 represents a distributor vane 1 of the prior art, wherein the cooling is assured by a multi-perforated longitudinal sleeve 4. The vane 1 extends between two platforms: an inner platform 3 and an outer platform 2, which delimits the annular gas circulation channel 5 within the turbine. This channel is subdivided circumferentially by the vanes 1.

The multi-perforated sleeve 4 is slid longitudinally into the central cavity 6 of the vane 1. At the level of the outer platform 2, a duct 7 feeds the sleeve 4 with cold air taken from the compressor, for example. Because of the pressure difference existing between the inside of the sleeve 4 and the peripheral zone of the cavity 6 delimited by the outside wall of the sleeve 4 and the inside wall of the vane 1, a portion of the air is projected via the perforations of the sleeve 4 against the inside wall of the vane 1, thus assuring its cooling. This air is then evacuated in the gas stream 5, along the trailing edge of the vane 1, by calibrated perforations. The rest of the air is evacuated across the inner platform 3 into a second duct 8, which guides it towards the other parts of the motor to be cooled, such as the turbine disk or the turbine bearings.

The central cavity 6 of the vane 1 comprises two openings 9, 10 at the level of the outer platform 2 and the inner platform 3, respectively. At the time of assembly of the vane, the sleeve 4 is slid through the outer opening 9 of the vane 1 and firmly affixed to the outer platform 2, generally by brazing along the wall of the outer opening 9. The opposing part of the sleeve 4 is guided into the inner opening 10 of the vane 1, forming a guide into the inner platform 3 in order to authorize relative displacements between the sleeve and the vane. (This is why the inner opening 10 is also referred herein to as the guide 10.) Indeed, because of the differences between the materials and the manufacturing methods between the vane 1 and the sleeve 4, as well as between the operating temperatures, there results a variation in elongation between the vane 1 and the sleeve 4. The guide 10 helps maintain the configuration of the vane assembly.

The vane 1 is formed by casting, while the sleeve 4 is formed by shaping of a metal sheet. Considering the difference between the methods of manufacturing the vane 1 and the sleeve 4, the clearance along the guide 10 is relatively significant; this clearance results especially from the manufacturing tolerances. It creates an air leak at the level of the exit from the sleeve 4, since the pressure in the peripheral zone of the cavity 6 is lower than that in the central canal formed by the sleeve 4.

Referring to FIG. 2, the air leak represented by the arrow F has the first drawback of creating an overpressure in the peripheral zone of the cavity 6. This overpressure is prejudicial to the internal cooling of the vane 1, and more particularly at the level of the leading edge zone, which is the hottest zone, since the air passing in the central cavity of the sleeve 4 has less tendency to be projected via the perforations of the sleeve 4 against the inside wall of the vane 1. Moreover, the air coming from the leakage does not participate in the cooling of the vane, since it is guided directly towards the evacuation orifices situated on the trailing edge. In addition, the quantity of air guided into the duct 8 in order to cool other parts of the engine is reduced by virtue of the leakage.

It has been proposed to eliminate the air leakage by means of sealing systems, but these latter adversely affect the sliding of the sleeve 4 in the guide 10, necessary to the compensation of the dilatation differences mentioned above.

The present invention proposes eliminating these drawbacks.

To this end, the invention relates to a cooled gas turbine engine vane comprising a cast part and a longitudinal sleeve for guiding the flow of cooling air obtained by shaping sheet metal, the cast part comprising a longitudinal body provided with a longitudinal cavity with a first opening for feeding and a second opening for evacuation of air at the extremities, the sleeve being mounted in the cavity by being attached to the wall of the first opening, one end part of which being free to slide into the second opening forming a guide, characterized in that said end portion guided by the guide comprises a constriction of its passage cross-section for the air flow.

The solution proposed by the invention is simple and economical. It also offers the advantage of making it possible to calibrate the cooling flow of the disks.

The invention will be better appreciated in virtue of the following description of the vane according to the invention, with reference to the appended drawings, wherein.

Although the invention applies to any type of vane, it will be described especially in connection with a turbine nozzle vane.

Figure 1:
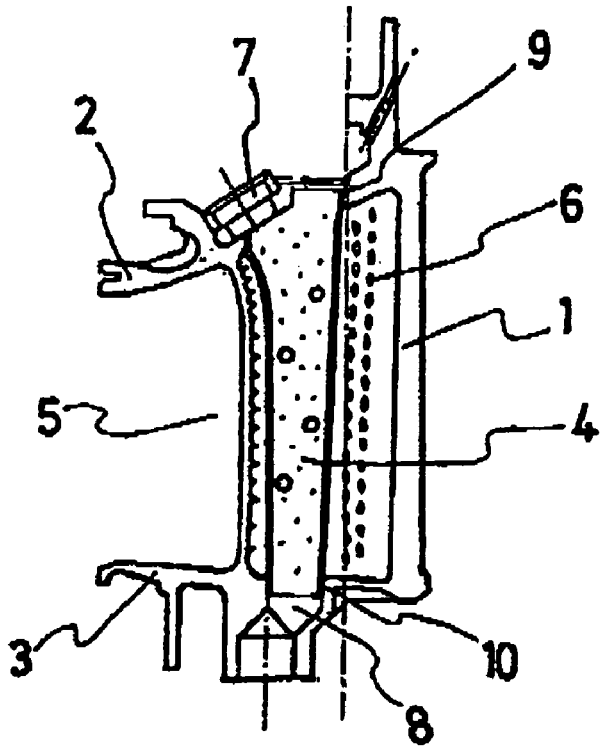
FIG.1 PRIOR ART
FIG. 1 represents a sectional profile view of a prior art vane.
Figure 2:
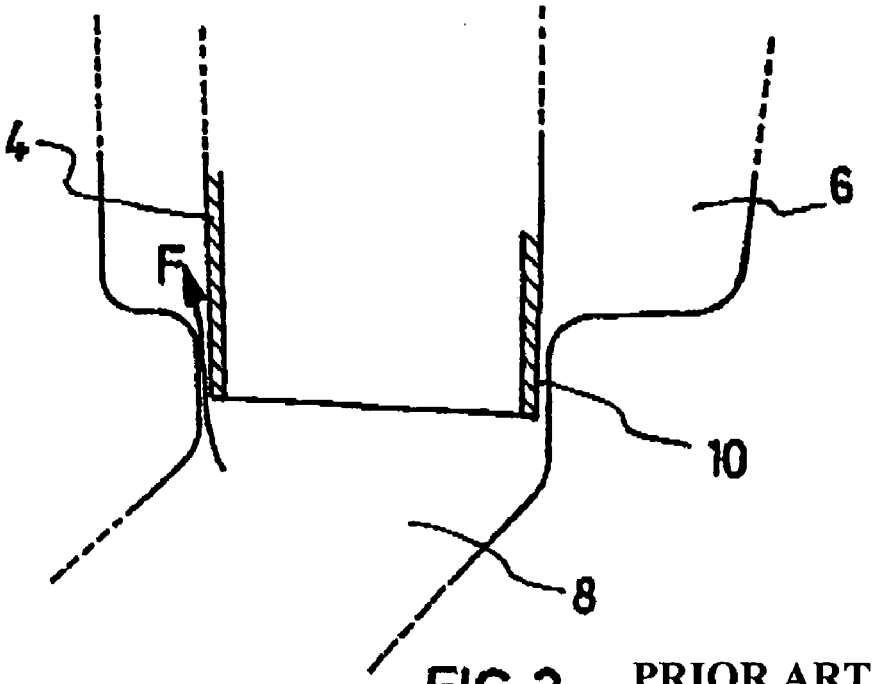
FIG.2 PRIOR ART
FIG. 2 represents a sectional profile view of the sleeve in the guide of the vane of FIG. 1.
Figure 3:
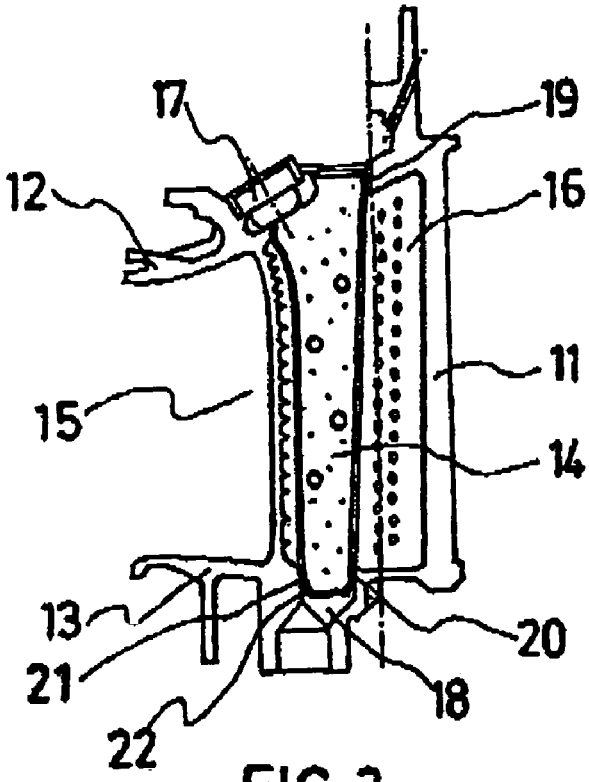
FIG. 3 represents a sectional profile view of a first embodiment of the vane according to the invention.

With reference to FIG. 3, the distributor vane 11 according to the invention extends between an outer platform 12 and an inner platform 13 of the gas turbine engine nozzle, which delimits an annular gas circulation channel 15 in the turbine. It comprises a central longitudinal cavity 16 having two openings, an outer 19 and an inner 20, at the level of the outer platform 12 and the inner platform 13, respectively.

A sleeve 14 is inserted into the central cavity 16 of the vane, accommodating a peripheral cooling cavity between the outside wall of the sleeve 14 and the inside wall of the vane 11. The sleeve 14 is attached to the wall of the outer opening 19 of the vane 11 by brazing or welding, for example. In addition, it is guided at an end part 21 into the inner opening 20 forming a sliding guide for this purpose. Accordingly, it is possible for it to slide into the guide 20 in order to make the assembly of the vane united, notwithstanding the differential dilatations between its various elements.

At the outer platform 12, the sleeve 14 is supplied by a duct 17 with air coming from the cooler levels of the turbine engine. Because of the pressure difference existing between the central cavity of the sleeve 14 and the peripheral cooling cavity of the cavity 16, a portion of this air is projected from the central cavity of the sleeve 14 towards the inside wall of the vane by perforations provided to this end on the sleeve 14, especially on the side of the leading edge of the vane 11. This air is then evacuated by calibrated perforation on the trailing edge of the vane 11.

The portion of the air not projected onto the inner wall of the vane 11 is evacuated from the sleeve 14 through a duct 18 extending at the level of the inner platform 13 following the guide 20.

Figure 4:
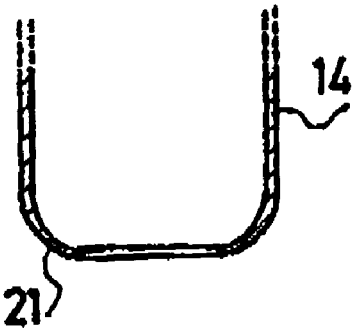
FIG. 4 represents a sectional profile view of the sleeve in the guide of the vane of FIG. 3.

With reference to FIG. 4, the sleeve 14 of the vane 11 of FIG. 3, formed by folding sheet metal, is folded in the zone of its end portion 21 guided by the guide 20 so as to form a constriction 22 for the air flow that is guided into its cavity. More precisely, the constriction 22 is realized in the zone of the end part 21 of the sleeve 14 arranged to be located inside the guide 20. In the embodiment of FIG. 4, this folding has a curved profile.

In fact, the objective is to create, in the end part 21 of the sleeve 14 guided by the guide 20, a zone 22, the transverse dimensions of which are clearly constricted relative to the transverse dimensions of the guide 20.

Accordingly, in virtue of the folding of the sleeve 14, a loss of load is created at the folded end 22 of the sleeve 14. This loss of load causes a drop in the static pressure at the outlet of the sleeve 14. Consequently, in virtue of an ad hoc conformation of the fold, it is possible to regulate the static pressure at the outlet of the sleeve 14 relative to the static pressure of the cooling zone of the cavity 16 of the vane in such a fashion as to eliminate, or at least reduce, within the guide 20, the leakage of air at the outlet of the sleeve 14 towards said cooling zone.

Accordingly, in virtue of the invention, it is possible to remedy the air leakage without changing the structure nor the mode of realizing the body of the vane 11, by suitably conforming the end part 21 of the sleeve 14, without additional production costs.

Figure 5:
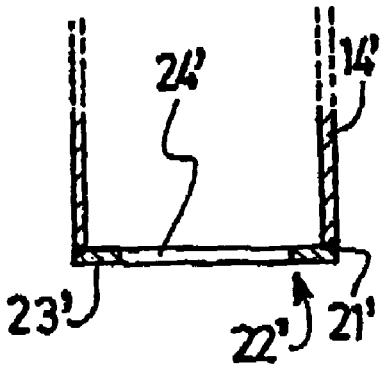
FIG. 5 represents a sectional profile view of the sleeve of a second embodiment of the vane according to the invention.

FIG. 5 represents a second embodiment of a sleeve 14' of the vane 1. In the latter, it is proposed, in order to obtain results identical to the previous ones, brazing or welding, to the end of the end part 21' of the sleeve 14' intended to be guided by the guide 20, a calibrated plate 23' perforated over the greater part of its surface, in the present case, of an air passage opening 24'. In this fashion, a part 22' having constricted transverse dimensions relative to the transverse dimensions of the guide 20 is obtained.

Figure 6:
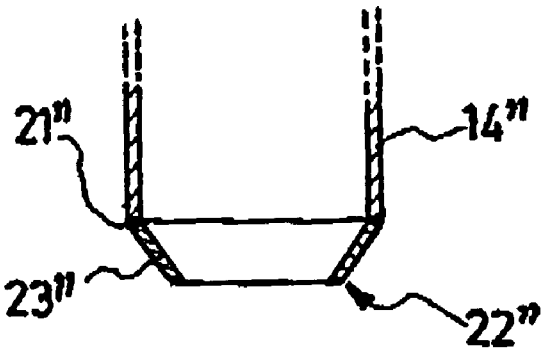
FIG. 6 represents a sectional profile view of the sleeve of a third embodiment of the vane according to the invention.

FIG. 6 represents a third embodiment of a sleeve 14" of the vane 1. In this latter instance, it is proposed to braze a conical tube 23", whose transverse dimensions narrow in moving away from the sleeve end 14", to the end of the end part 21" of the sleeve 14' intended to be guided by the guide 20. In this fashion, a part 22" having constricted transverse dimensions relative to the transverse dimensions of the guide 20 is obtained.

The third embodiment of the sleeve according to the invention is advantageous relative to the second in that it makes it possible to minimize the load losses at the inlet of the cone.

The invention claimed is:

1. A cooled gas turbine engine vane comprising a cast part and a longitudinal sleeve, for guiding the flow of cooling air, obtained by shaping sheet metal, the cast part comprising a longitudinal body provided with a longitudinal cavity having a first opening for feeding and a second opening for evacuation of air at the extremities, the sleeve being mounted in the cavity, by being attached to the wall of the first opening, one end part of which being free to slide into the second opening forming a guide, wherein said end part guided by the guide comprises a constriction of its passage crossing-section for the air flow, wherein a dimension of said constriction diminishes while extending away from the cavity.

2. The vane according to claim 1, wherein the sleeve is attached to the wall of the first opening by welding or by brazing.

3. The vane according to claim 1, wherein the constriction is obtained by folding the end of the sleeve.

4. The vane according to claim 3, wherein the folding is of curved profile section.

5. The vane according to claim 1, wherein the sleeve is perforated.

6. The vane according to claim 5, wherein the cast part comprises calibrated perforations.

7. A cooled gas turbine engine vane comprising:

a cast part comprising a longitudinal body defining a longitudinal cavity with a first opening and a second opening;

a longitudinal sleeve made of sheet metal and configured to guide a flow of cooling air, said sleeve being mounted in said cavity and attached to a wall of the first opening, and said sleeve having an end part that is free to slide into the second opening; and means for forming an air flow constriction at said end part of said sleeve and for reducing static pressure at an outlet of said sleeve, wherein said means have a dimension that diminishes away from the cavity.

8. The vane according to claim 7, wherein said means comprise a folded portion of said end part of the sleeve.

9. The vane according to claim 7, wherein said means comprise a perforated plate.

10. The vane according to claim 7, wherein the sleeve is perforated.

11. The vane according to claim 7, wherein the cast part comprises calibrated perforations.

12. A cooled gas turbine engine vane comprising:

a cast part comprising a longitudinal body defining a longitudinal cavity with a first opening and a second opening;

a longitudinal sleeve made of sheet metal and configured to guide a flow of cooling air, said sleeve being mounted in said cavity and attached to a wall of the first opening, and said sleeve having an end part that is free to slide into the second opening:

means for forming an air flow constriction at said end part of said sleeve and for reducing static pressure at an outlet of said sleeve; and wherein said means comprise a tube having a conical shape and cross-section dimensions that diminish away from the cavity.

13. A cooled gas turbine engine vane comprising:

a cast part comprising a longitudinal body defining a longitudinal cavity with a first opening and a second opening;

a longitudinal sleeve made of sheet metal and configured to guide a flow of cooling air, said sleeve being mounted in said cavity and attached to a wall of the first opening, and said sleeve having an end part that is free to slide into the second opening; and a tube attached to said end part of the sleeve and forming an air flow constriction, wherein the tube has a conical shape, whose cross-section dimensions diminish while extending from the end part of the sleeve.

* * * * *

UNITED STATES PATENT AND TRADEMARK OFFICE

CERTIFICATE OF CORRECTION

PATENT NO. : 7,204,675 B2
APPLICATION NO. : 10/916435
DATED : April 17, 2007
INVENTOR(S) : Christophe Texier It is certified that error appears in the above-identified patent and that said Letters Patent is hereby corrected as shown below:

Column 3, line 64, change " 14' " to -- 14" --.

Signed and Sealed this

Twenty-eighth Day of August, 2007

JON W. DUDAS
*Director of the United States Patent and Trademark Office*